US005435761A

United States Patent [19]

Shimamune et al.

[11] Patent Number: 5,435,761

[45] Date of Patent: Jul. 25, 1995

[54] UNDERWATER PROPULSION METHOD AND APPARATUS

[75] Inventors: Takayuki Shimamune; Yasuo Nakajima, both of Tokyo, Japan

[73] Assignees: Permelec Electrode Ltd., Kanagawa, Japan; De Nora Permelec S.P.A., Milan, Italy

[21] Appl. No.: 177,375

[22] Filed: Jan. 5, 1994

[30] Foreign Application Priority Data

Jan. 7, 1993 [JP] Japan ..... 5-016937

[51] Int. Cl.[6] ..... B60L 11/02

[52] U.S. Cl. ..... 440/6

[58] Field of Search ..... 310/11; 60/202, 203.1, 60/204; 440/6, 38; 313/631, 632; 417/50; 290/52, 42

[56] References Cited

U.S. PATENT DOCUMENTS 4,767,953 8/1988 Furuya et al. ..... 310/11

5,249,990 10/1993 Laukien ..... 440/6

FOREIGN PATENT DOCUMENTS 4029443 5/1991 Germany ..... 440/6

OTHER PUBLICATIONS

Proceedings Of The 25th Intersociety Energy Conversion Engineering Conference, vol. 5, "Analyses Of Underwater Magnetohydrodynamic Propulsion", Aug. 12–17, 1990, J. B. Gilbert and T. F. Lin.

*Primary Examiner*—Edwin L. Swinehart

*Attorney, Agent, or Firm*—Sughrue, Mion, Zinn, Macpeak & Seas

[57] ABSTRACT

The underwater propulsion apparatus, which is mounted on a ship, has the anode and cathode electrodes including an anode compartment and cathode compartment whose electrode materials are separated from seawater in a central duct by the ion exchange membranes so that they are protected from poisoning by seawater. In the method utilizing the apparatus, the anode compartment and cathode compartment are supplied with moist hydrogen and moist oxygen, respectively, so as to substantially suppress the evolution of gas in the duct, which lowers the thrusting force.

12 Claims, 1 Drawing Sheet

UNDERWATER PROPULSION METHOD AND APPARATUS

BACKGROUND OF THE INVENTION

1. Field of the Invention

The present invention relates to an underwater propulsion apparatus which is designed to generate an electromagnetic force by application of an electric field and a magnetic field in substantially perpendicular directions in water. More specifically, the present invention relates to an underwater propulsion apparatus to be mounted on a ship as a primary drive therefor. The present invention also relates to a method for propelling a ship by application of electric and magnetic fields that are substantially perpendicular.

2. Description of the Related Art

Since the 1950s, it has been considered to apply an electric field in a direction perpendicular to a strong magnetic field, so as to obtain an electromagnetic force which is used for propelling a submarine or ship, or for transferring a liquid.

Conventional propulsion methods are limited in propeller turning force, and cannot achieve sufficient speed. On the other hand, the above method using the electromagnetic force, in which the speed increases in proportion to the respective strengths of the electric field and the magnetic field, can obtain a sufficient high speed. However, the idea was not put to practical use in the 1950s when it was impossible to produce a strong enough electric field and magnetic field to obtain a desired high speed.

The recent practical superconducting magnet, capable of producing a magnetic field of the order of several teslas, is expected to make it practical to use the electromagnetic force for ship propulsion. In fact, this idea has proven successful experimentally. Presently, it is possible to produce a strong magnetic field by the aid of a superconducting magnet. However, the electric field must also be sufficiently strong in order to obtain a satisfactory high speed.

When the electric field is applied to water, water and materials dissolving in water are electrolyzed. That is, an electric current is sent so as to electrolyze water or seawater. The electrolysis produces hydrogen gas, oxygen gas, or the like. Although the electrolysis merely consumes a negligibly small portion of electric power, hydrogen gas and sodium hypochlorite are produced in case of seawater electrolysis. Hydrogen is explosive, in spite of its small amount and diffusibility into air. Sodium hypochlorite, which is an oxidizing agent and disinfectant used for water purification, may form organic chlorides which cause environmental pollution, although it would pose no toxicity problem after dilution.

Upon the electrolysis of seawater (i.e., the electrolysis of water including sodium chloride), chlorine ions and hydroxyl ions in seawater preforms either or both of the following reactions as the result of their oxidation (or loss of electrons) on the anode.

$$2Cl^- \rightarrow Cl_2 + 2e^- \quad (1)$$

$$4OH^- \rightarrow O_2 + 2H_2O \quad (2)$$

Although it is possible to cause to proceed either of the other reactions by selection of an adequate electrode, usually the reaction (1) is caused to proceed predominantly and the produced chlorine gas reacts with sodium hydroxide obtained on the cathode to produce sodium hypochlorite according to the following reaction.

$$Cl_2 + 2NaOH \rightarrow NaClO + NaCl + H_2O \quad (3)$$

A manganese compound mainly including manganese dioxide is used for the seawater electrolysis so as to be able to cause reaction (2) to proceed selectively. Such a manganese compound is satisfactory for laboratory use. However, the compound does not have a long enough life because of slightly poor conductivity and chemical stability thereof under a high current density of 50–100 $A/dm^2$. At present, there are no substance in its stead.

Even though it is possible to produce a substance which causes reaction (2) to proceed selectively without the environmental pollution, there still remains a serious problem in that the evolution of detonational oxyhydrogen gas is not only dangerous but also undesirable because it impedes the water flow and lowers the propulsive force. Accordingly, it is not preferable to diffuse the gas into air.

In order to avoid the gas production which is accompanied with the above problem, a gas electrode is used to depolarize with gas. For example, instead of the anode reaction represented by formula (2), there takes place a reaction as indicated in formula (4) below without evolving gas, if the anode is supplied with hydrogen continuously. In addition, instead of the above cathode reaction, there takes place a reaction as shown in formula (5) below without evolving gas, if the cathode is supplied with oxygen continuously.

$$2OH^- + H_2 \rightarrow 2H_2O + 2e^{31} \quad (4)$$

$$4H^- + O_2 + 4e^- \rightarrow 2H_2O \quad (5)$$

In general, a gas electrode includes a hydrophilic layer and a hydrophobic layer. The hydrophilic layer is in contact with the electrolyte and gas for a reaction. However, when the catalyst in the hydrophilic layer contacts an electrolyte having impurities, especially seawater, it is easily tainted by the impurities. Although the gas electrode has satisfactory efficiency in the beginning of sending the current, the gas electrode becomes ineffective by poisoning the catalyst in a short time in its practical use, such as in seawater; therefore it cannot solve the above problem.

There is a further problem in that a gas supplied to the gas electrode through the hydrophobic layer has to be a high-purity gas under high pressure. Accordingly, such a problem limits the size of the electrode. For the reasons mentioned above, the gas electrode has never been put to practical use for the propulsion apparatus which uses electromagnetic force.

SUMMARY OF THE INVENTION

The present invention has an object to solve the above-mentioned problems and to provide an underwater propulsion apparatus including a gas electrode which allows current to be sent underwater without the evolution of gas.

An underwater propulsion apparatus of the present invention, which applies an electric field and a magnetic field in substantially perpendicular directions so as to generate an electromagnetic field, comprises a magnetic field generating unit for generating the magnetic field, gas electrodes for generating the electric field, which includes an anode having an anode member for hydrogen depolarization and an anode compartment supplied with moist hydrogen gas and a cathode having a cathode member for oxygen depolarization and a cathode compartment supplied with moist oxygen gas, and an ion exchanger disposed on at least one of the contact portion of the anode with water and the contact portion of the cathode with water, wherein said apparatus applies electric current across the electrodes so as to generate the electromagnetic field with supplying the moist hydrogen and the moist oxygen to said anode compartment and said cathode compartment, respectively.

A method of propelling a ship of the present invention, utilizing the above apparatus, comprises the steps of generating a magnetic field around an open volume of water, and generating an electric field, substantially perpendicular to the magnetic field, around the open volume of water, without causing gas to evolve, wherein the electric field generating step is performed by electrodes disposed on opposite sides of the open volume of water, and wherein ion exchange means are disposed between the electrodes and the water. The method further comprises the steps of electrolyzing water to produce hydrogen gas and oxygen gas, and supplying the hydrogen gas and the oxygen gas to the electrodes, the hydrogen gas being supplied to an anode of the electrodes and the oxygen gas being supplied to a cathode of the electrodes. The method preferably includes humidifying said hydrogen gas and said oxygen gas to a specific level of humidity.

In an underwater propulsion apparatus which generates an electromagnetic force by applying a magnetic field and an electric field in substantially perpendicular directions, a strong electric field has to be generated so as to obtain a great propulsive force. Moreover, it is preferable to use a gas electrode which evolves substantially no gas, because the evolution of gas in the underwater propulsion apparatus decreases the propulsive force. Usually the electrode of the underwater propulsion apparatus is immersed in seawater and hence the electrode is subject to rapid corrosion leading to short life by impurities contained in seawater when it is used with a high current density.

Accordingly, in the present invention, this disadvantage is eliminated by providing at least one of the anode and cathode with an ion exchanger which prevents the electrode from coming into direct contact with seawater containing a large amount of impurities. This arrangement protects the electrode from poisoning and lengthens the life of the electrode.

As described above, it is necessary that the underwater propulsion apparatus evolve no gas so as to produce its maximum propulsive force. Accordingly, in the present invention, a hydrogen gas electrode and an oxygen gas electrode are used as the anode and the cathode, respectively.

These gas electrodes permit the desired following reactions if the reaction gas and water are present on the surface of the electrode. Moreover, they permit the desired reactions and sending current if a liquid containing hydrogen ions and hydroxide ions are supplied to the electrolyte through their surface.

Anode reaction: $H_2 \rightarrow 2H^+ + 2e^-$ (6)

Cathode reaction: $O_2 + 2H_2O \rightarrow 4OH^- + 4e-$ (7)

The hydrogen ions freely migrate in a cation exchanger such as a cation exchange membrane and the hydroxide ions freely migrate in an anion exchanger such as an anion exchange membrane. If the electrodes are polarized, the hydrogen ions and the hydroxide ions migrate toward the anode and the cathode, respectively. Thus, the cation exchanger is disposed between the anode and the electrolyte or the anion exchanger is disposed between the cathode and the electrolyte so as to prevent directly contacting the electrolyte with electrode materials. Therefore, the electrode materials are free from being poisoned by impurities contained in the electrolyte.

DESCRIPTION OF THE PREFERRED EMBODIMENT

Figure 1:
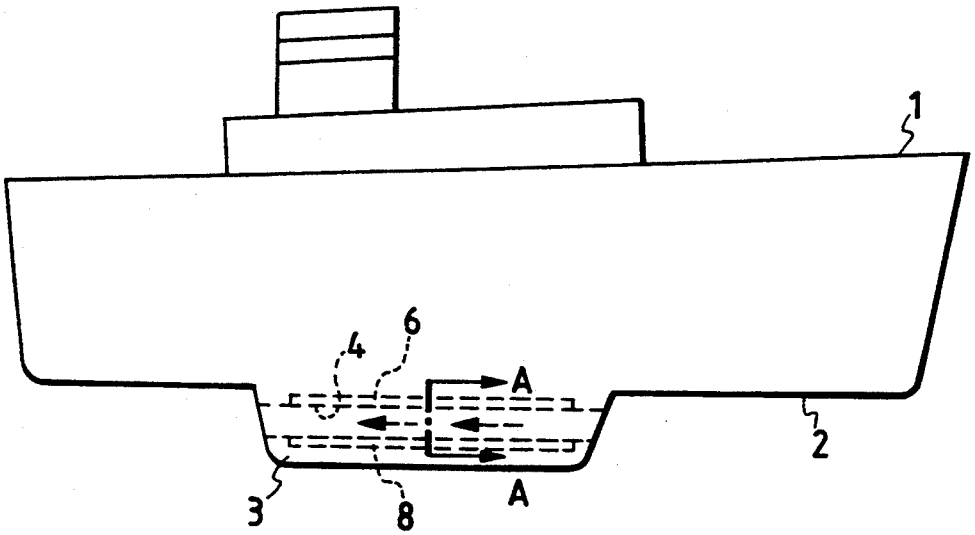
FIG. 1 is a schematic longitudinal sectional view of an ordinary ship equipped with a underwater propulsion apparatus of the present invention.
Figure 2:
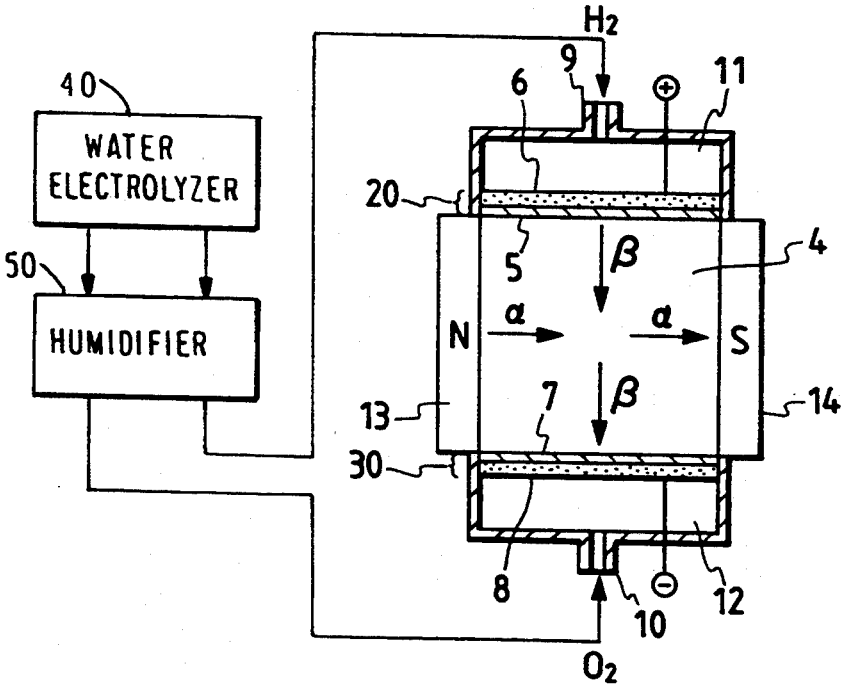
FIG. 2 is a sectional view taken along the line A—A in FIG. 1.

A preferred embodiment of the present invention will now be described.

The anode and cathode are supplied respectively with moist hydrogen and moist oxygen, preferably steam-saturated hydrogen and oxygen, 5–10% in excess of the theoretical amount, such that the hydrogen and oxygen come into contact with the electrode materials. The above performances reduce the overvoltage and permits electrifying at a sufficiently low voltage.

The hydrogen and oxygen gas do not need drying and/or decarbonation as the conventional gas electrode but are merely supplied directly to the electrode. Since the moist gas is preferable and the moist hydrogen and oxygen are supplied in a ratio of 2:1, the hydrogen gas and the oxygen gas produced by the water electrolysis can be supplied directly to the electrode without refining. If the obtained hydrogen and oxygen are not sufficiently moist, both gases can be supplied through a humidifier. The hydrogen and oxygen may be supplied at a pressure of 10 cm ($H_2O$) without pressurizing.

According to the present invention, the underwater propulsion apparatus needs a water electrolyzer which produces hydrogen gas and oxygen gas to be supplied to the gas electrodes. It may be considered that it consumes additional electric power; but in practice its power consumption is too small to be important as compared with the power (50 A/dm$^2$ and 200–300 V) required to send current through seawater across a gap of about 20 cm. The onboard gas production by electrolysis is more economical than gas transportation or purification.

Both gases make contact with the cathode and anode material, and react with water so as to proceed the reactions represented by the formulas (6) and (7) without gas evolution. The hydrogen ions and hydroxide ion thus obtained migrate to the electrolyte through the ion exchanger (or directly in the case where no ion exchanger is present) to supply water.

It is preferable to use an ion exchange membrane as the ion exchanger in the present invention. Particularly, in the case where not only the apparatus but also the electrode is large in size, it is desirable to use the ion exchange membrane that is uniformly in contact with the electrode material. The ion exchange membrane may be replaced by an ion exchange resin applied to the entire surface of the electrode material.

A preferable ion exchange membrane is a fluorine-based ion exchange membrane commercially available under the trade name "Nafion", which is resistant to high-speed water flow. A hydrocarbon-based one may also be acceptable because it is not exposed to a severe environment.

The ion exchange membrane only needs to be in contact with the electrode material so long as the current density is low (30–40 A/dm$^2$ or less); however, they have to be connected to each other if the current density exceeds 40 A/dm$^2$. The connection may be accomplished by hot pressing or cold pressing, the former being preferable.

In case of ion migration where the ions permeate through the ion exchanger, resistance is generated in the ion exchanger to raise the voltage. The voltage rise due to ohmic loss at the anode is almost negligible, which is lower than 0.1 V at a current density of 30 A/dm$^2$, because hydrogen ions are small in size. In contrast, the voltage rise due to ohmic loss at the cathode is comparatively high, which is about 0.6 V or 1 V at a current density of 30 A/dm$^2$ or 50 A/dm$^2$, respectively, because hydroxyl ions are large and accompanied with water.

The electrode material used in the present invention can be the same as the one used in the conventional gas electrode, for example, in which a catalyst such as platinum black is supported on porous conductive carbon. Since the produced ions migrate toward the ion exchanger through the water layer on the surface of the electrode material, the surface gets moist with water and may not sufficiently contact the gas if the surface is hydrophilic. Accordingly, it is preferable that the surface is hydrophobic to some extent by the aid of a fluororesin binder.

The above mentioned superconducting magnet or the like can be used as the magnetic field generating device for the apparatus of the present invention.

The underwater propulsion apparatus of the present invention may be used for ordinary ships as well as for submarines. A duct is installed on a part of the hull, which is substantially parallel to the forward direction of a ship. The anode and cathode gas electrodes are provided to oppose each other around the duct with their respective ion exchangers being disposed between them and the duct. The superconducting magnet is provided so as to generate the magnetic field perpendicular to the electrical field generated by the gas electrodes. As the electrodes are energized, the electric field and magnetic field generate electromagnetic force, thereby thrusting the ship forward according to Fleming's left-hand rule.

Since the electromagnetic force is proportional to the intensities of the electric field and magnetic field, it is possible to achieve a desired speed by controlling the current density of the electrodes or by controlling the magnetic force of the superconducting magnet. Moreover, the gas electrode of the present invention has a very long life owing to the ion exchanger which protects the electrode material from direct contact with the impurities contained in seawater. Therefore, the present invention contributes to make the underwater propulsion apparatus for practical use. Also, the gas electrode evolves substantially no gas that lowers the thrusting force.

The invention will now be described with reference to the accompanying drawings.

As shown in FIG. 1, a downward protrusion 3 is formed on the center of the bottom 2 of a ship 1, wherein at least one duct 4 is provided on the downward protrusion 3 parallel to the forward direction of the ship 1. An anode 20, including a cation exchange membrane 5 and an anode material 6, is provided at the top of the duct 4. Further, a cathode 30, including an anion exchange membrane 7 and a cathode material 8, is provided at the bottom of the duct 4. The anode 20 is stored in an anode compartment 11 having a hydrogen inlet 9, and the cathode 30 is stored in an cathode compartment 12 having a oxygen inlet 10. The hydrogen and oxygen gases are supplied by water electrolyzer 40. If the gases are sufficiently moist, they may be humidified by humidifier 50 prior to being supplied to inlets 9 and 10.

An N pole 13 of a magnet is mounted on one side of the duct 4 and an S pole 14 of a magnet is mounted on the other side of the duct 4. The two poles create a magnetic field as indicated by arrows $\alpha$.

Upon application of a voltage across the electrodes 6 and 8 while supplying moist hydrogen and moist oxygen to the anode compartment 11 and cathode compartment 12, respectively, the anode material 6 oxidizes hydrogen into hydrogen ions and the cathode material 8 reduces water into hydroxyl ions. The hydrogen ions migrate into the duct 4 through the cation exchange membrane 5, and that hydroxyl ions migrate into the duct 4 through the anion exchange membrane 7. The flow of the ions generates an electric field as indicated by arrows $\beta$.

The thus formed magnetic and electric fields generate an electromagnetic force astern in the duct 4, as indicated by the dotted line arrows in FIG. 1, according to Fleming's left hand rule. This electromagnetic force induces a repulsive force which thrusts the ship 1 forward (rightward in FIG. 1).

In the apparatus of the embodiment, since the electrode materials 6 and 8 contact with the duct 4 through the ion exchange membranes 5 and 7, respectively, the electrode material do not directly contact with seawater (if seawater is present in the duct 4). Therefore, the lives of the electrode materials 6 and 8 can be extended. Moreover, the hydrogen and oxygen supplied to the anode compartment and the cathode compartment, respectively, suppress the evolution of gas so as to convert the electromagnetic force into propulsive force more efficiently.

The following illustrates an example of the present invention and a comparative example.

Example 1

An electrode material was prepared by 1) mixing graphite powder having an average particle diameter of 20–40 nm and a second powder, which is the same as the graphite powder except that it is coated with platinum by the physical vapor deposition method, to produce a mixture, 2) kneading the mixture with polytetrafluoroethylene (PTFE) resin so as to obtain a kneaded member, 3) applying the kneaded member to a graphitized pitch-based carbon fiber cloth in the size of 10×10 cm, and 4) baking it at 250° C. under a weight exerting a pressure of 20 kg/cm$^2$. The Nafion solution containing the ion exchange resin produced by Solution Technology Co., Ltd. was applied to the surface of the electrode material so as to be hydrophobic.

An anode was prepared by pasting a cation exchange membrane which is "Nafion 117" produced by E. I.

DuPont de Nemours & Co. to the carbon fiber cloth coated with the electrode material.

A cathode was prepared in the same manner as above by pasting an anion exchange membrane produced by Asahi Chemical Industry Co., Ltd. to a carbon fiber cloth coated with an electrode material in which the Nafion solution was replaced by an anion exchange resin solution comprising PTFE resin powder swollen and dispersed by the aid of sodium hydroxide.

An anode current collector was formed from a 0.5 mm thick platinum-plated titanium expand mesh having an opening of 6.0×3.5 mm. A cathode current collector is formed from a nickel expand mesh of the same dimensions as above.

The gas electrodes prepared as mentioned above were disposed opposite each other at a distance of 20 cm. Cathode hydrogen gas produced in another water electrolysis apparatus was supplied to the anode after passing through a water layer thereof in order to sufficiently humidify the gas. Likewise, anode oxygen gas produced in the water electrolysis apparatus was supplied to the cathode after passing through a water layer thereof in order to humidify the gas. Both gases were supplied under a pressure of 20 cm ($H_2$) and a humidity 15% in excess of the theoretical amount. A space between the electrodes was filled with seawater having a specific resistance of 25 Ω.cm, and an electric current of 50 A was applied across the electrodes. In this case, the current across the electrodes has a voltage of 252 V, which is 2 V higher than that of the seawater. During the above operation, no gas bubbles evolved in the seawater. Incidentally, only a 2 V increase is needed for water electrolysis for the supply of hydrogen gas and oxygen gas, bringing the total to 254 V. This is only 1 V higher than the 253 V required for the process in which gases are evolved. After continuing the above electrolysis operation for 10 days, the voltage remained at 252–253 V, with very little increase.

Comparative Example 1

The same procedure as in Example 1 was repeated except that the carbon fiber cloth alone (without the cation exchange resin and anion exchange resin) was used as the anode and cathode. The voltage at the beginning was 252 V as in Example 1; however, the voltage increased to 254 V after 10 days of operation.

The underwater propulsion apparatus of the present invention may be used for ordinary ships as well as for submarines. A duct is installed on a part of a hull, which is substantially parallel to the forward direction of a ship. The anode and cathode gas electrodes are provided to oppose each other around the duct with their respective ion exchangers being disposed between them and the duct. The superconducting magnet is provided so as to generate the magnetic field which is substantially perpendicular to the electrical field generated by the gas electrodes. As the electrodes are energized, the electric field and magnetic field generate an electromagnetic force thrusting the ship ahead according to Fleming's left-hand rule.

Since the electromagnetic force is proportional to the intensities of the electric field and magnetic field, it is possible to achieve a desired speed by controlling the current density of the electrodes or by controlling the magnetic force of the superconducting magnet. Moreover, the gas electrode of the present invention has a very long life owing to the ion exchanger which protects the electrode material of the gas electrode from direct contact with impurities contained in seawater. Therefore, the present invention can be practically used as an underwater propulsion apparatus. Also, the gas electrode evolves substantially no gas that lowers the thrusting force.

The anode compartment and cathode compartment should preferably be supplied with moist hydrogen and moist oxygen in a ratio of 2:1, which are obtained by water electrolysis. The onboard gas production by electrolysis eliminates the necessity of transporting gases.

The foregoing description of preferred embodiments of the invention has been presented for purposes of illustration and description. It is not intended to be exhaustive or to limit the invention to the precise form disclosed, and modifications and variations are possible in light of the above teachings or may be acquired from practice of the invention. The embodiments were chosen and described in order to explain the principles of the invention and its practical application to enable one skilled in the art to utilize the invention in various embodiments and with various modifications as are suited to the particular use contemplated. It is intended that the scope of the invention be defined by the claims.

What is claimed is:

1. An underwater propulsion apparatus, which applies an electric field and a magnetic field in substantially perpendicular directions so as to generate an electromagnetic field, comprising:

magnetic field generating means for generating the magnetic field;

gas electrode means for generating the electric field, which includes an anode having an anode member for hydrogen depolarization and an anode compartment supplied with moist hydrogen gas, and a cathode having a cathode member for oxygen depolarization and a cathode compartment supplied with moist oxygen gas; and ion exchange means disposed on at least one of a contact portion of the anode with water and a contact portion of the cathode with water;

wherein said apparatus applies electric current across the electrodes so as to generate the electromagnetic field when supplying the moist hydrogen and the moist oxygen to said anode compartment and said cathode compartment, respectively.

2. An underwater propulsion apparatus as defined in claim 1, said apparatus further comprising water electrolysis means for electrolyzing water to produce the moist hydrogen gas and the moist oxygen gas which are supplied to said anode compartment and said cathode compartment, respectively.

3. An underwater propulsion apparatus as defined in claim 1, wherein said magnetic field generating means includes a superconducting magnet.

4. An underwater propulsion apparatus as defined in claim 1, wherein the moist hydrogen gas and the moist oxygen gas are steam-saturated hydrogen and oxygen gas which are 5–10% in excess of the theoretical amount.

5. An underwater propulsion apparatus as defined in claim 2, said apparatus further comprising humidification means disposed between said water electrolysis means and each of said anode compartment and cathode compartment for humidifying the moist hydrogen gas and the moist oxygen gas.

6. An underwater propulsion apparatus as defined in claim 1, wherein the surface of said anode member and said cathode member is hydrophobic.

7. An underwater propulsion apparatus as defined in claim 1, said apparatus being mounted on a protrusion on an underside of a ship including at least one duct substantially parallel to the direction of movement of the ship for passing through water, wherein said gas electrode means and said magnetic field generating means are provided around the duct.

8. An underwater propulsion apparatus as defined in claim 1, wherein said ion exchange means disposed on said anode contact portion includes a cation exchange membrane.

9. An underwater propulsion apparatus as defined in claim 1, wherein said ion exchange means disposed on said cathode contact portion includes an anion exchange membrane.

10. A method of propelling a ship, comprising the steps of:

generating a magnetic field around an open volume of water; and generating an electric field, substantially perpendicular to said magnetic field, around said open volume of water, without causing gas to evolve, by using gas electrodes disposed on opposite sides of said open volume of water; and disposing at least one ion exchange membrane between at least one of said electrodes and said water.

11. A method of propelling a ship according to claim 10, further comprising the steps of:

electrolyzing water to produce hydrogen gas and oxygen gas; and supplying said hydrogen gas and said oxygen gas to said electrodes, wherein said hydrogen gas is supplied to an anode of said electrodes and said oxygen gas is supplied to a cathode of said electrodes.

12. A method of propelling a ship according to claim 11, further comprising the step of humidifying said hydrogen gas and said oxygen gas to a specific level of humidity.

* * * * *